US011396201B2

(12) United States Patent
Feygelman et al.

(10) Patent No.: US 11,396,201 B2
(45) Date of Patent: Jul. 26, 2022

(54) APPARATUS AND METHOD FOR APPLYING A LIQUID TO A PRINTING SURFACE

(71) Applicant: Hewlett-Packard Development Company, L.P., Spring, TX (US)

(72) Inventors: Alex Feygelman, Ness Ziona (IL); Ben-Zion Ashtamker, Ness Ziona (IL)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/255,729

(22) PCT Filed: Sep. 5, 2018

(86) PCT No.: PCT/US2018/049488
§ 371 (c)(1),
(2) Date: Dec. 23, 2020

(87) PCT Pub. No.: WO2020/050831
PCT Pub. Date: Mar. 12, 2020

(65) Prior Publication Data

US 2021/0268824 A1 Sep. 2, 2021

(51) Int. Cl.
*B41M 7/00* (2006.01)
*B41J 11/00* (2006.01)

(52) U.S. Cl.
CPC ..... *B41M 7/0018* (2013.01); *B41J 11/0015* (2013.01)

(58) Field of Classification Search
CPC ..... B41J 11/0015; B41M 7/0018
See application file for complete search history.

(56) References Cited

U.S. PATENT DOCUMENTS 5,563,636 A 10/1996 Glassett et al.
5,596,354 A 1/1997 Murphy
(Continued)

FOREIGN PATENT DOCUMENTS

EP 0855274 1/2003
EP 2889242 3/2017

*Primary Examiner* — Scott A Richmond

(57) ABSTRACT

An apparatus (100) for applying a liquid to a printing surface (150). The apparatus comprise: a housing (110) arranged to receive the liquid, the housing comprising an aperture and the aperture comprising at least a first side defined by the housing and a second side defined by the housing which is opposite to the first side, such that the liquid can flow out of the housing by passing through the aperture between the first side and the second side; and a liquid guide member (120) which is inserted into the aperture so that the liquid guide member extends from the first side to the second side. The liquid guide member comprises: a first transfer surface; a second transfer surface which is separated from the first transfer surface by a gap; a first channel which extends from a first inlet which is adjacent to the aperture to a first outlet which is adjacent to the first transfer surface; and a second channel which extends from a first inlet which is adjacent to the aperture to a first outlet which is adjacent to the second transfer surface, the liquid guide member being arranged such that in use the liquid will flow along the first channel from the aperture to the first transfer surface and then transfer from the first transfer surface onto the printing surface, and the liquid will flow along the second channel from the aperture to the second transfer surface and then transfer from the second transfer surface onto the printing surface as the printing surface moves relative to the apparatus.

13 Claims, 4 Drawing Sheets

(56) References Cited

U.S. PATENT DOCUMENTS

| | | | |
|---|---|---|---|
| 7,360,863 | B2 | 4/2008 | Ballard et al. |
| 7,887,167 | B2 | 2/2011 | Comas et al. |
| 9,175,172 | B2 | 11/2015 | Regnier |
| 9,937,515 | B2 | 4/2018 | Feygelman et al. |
| 2008/0238990 | A1 | 10/2008 | Inoue |
| 2017/0246880 | A1 | 8/2017 | Wan et al. |
| 2017/0348964 | A1 | 12/2017 | Feygelman |
| 2018/0009239 | A1* | 1/2018 | Feygelman ..... B41J 11/0025 |

* cited by examiner

APPARATUS AND METHOD FOR APPLYING A LIQUID TO A PRINTING SURFACE

BACKGROUND

The process of printing sometimes involves applying coating of a primer to the surface of a member which is to be printed before the application of ink or other substances. Primer can be applied to the surface as a continuous coating, for example by applying the primer to an anilox roller and subsequently transferring the primer from the roller to the surface.

BRIEF DESCRIPTION OF THE DRAWINGS

Examples are further described hereinafter with reference to the accompanying drawings, in which.

DETAILED DESCRIPTION

It can be advantageous, when providing a coating of a liquid such as a primer across a surface, to provide spaces where the primer is not applied. These spaces may then be used for purposes which might be impeded by the presence of the liquid, such as the application of an adhesive.

Figure 1:
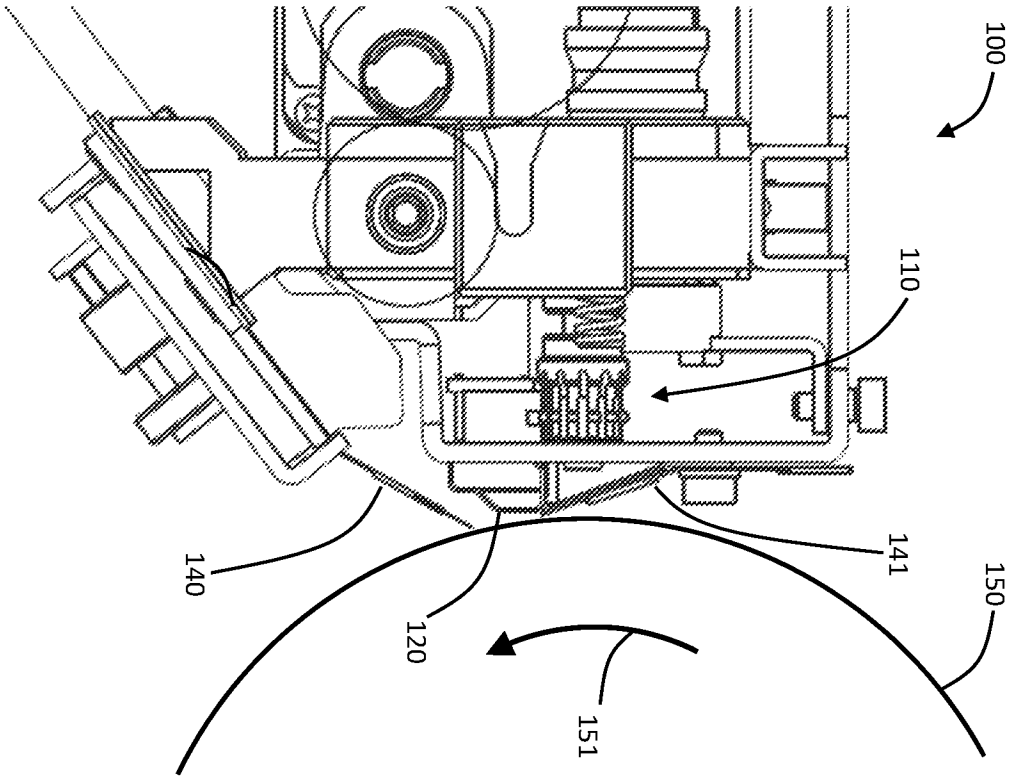
FIG. 1 illustrates a section of an apparatus for applying liquid to a printing surface according to some examples.

FIG. 1 is a diagram showing a section of an apparatus 100 for applying a liquid to a printing surface. The apparatus 100 comprises a housing 110, a liquid guide member 120, a first doctor blade 140, a second doctor blade 141 and an anilox roller 150.

Figure 2:
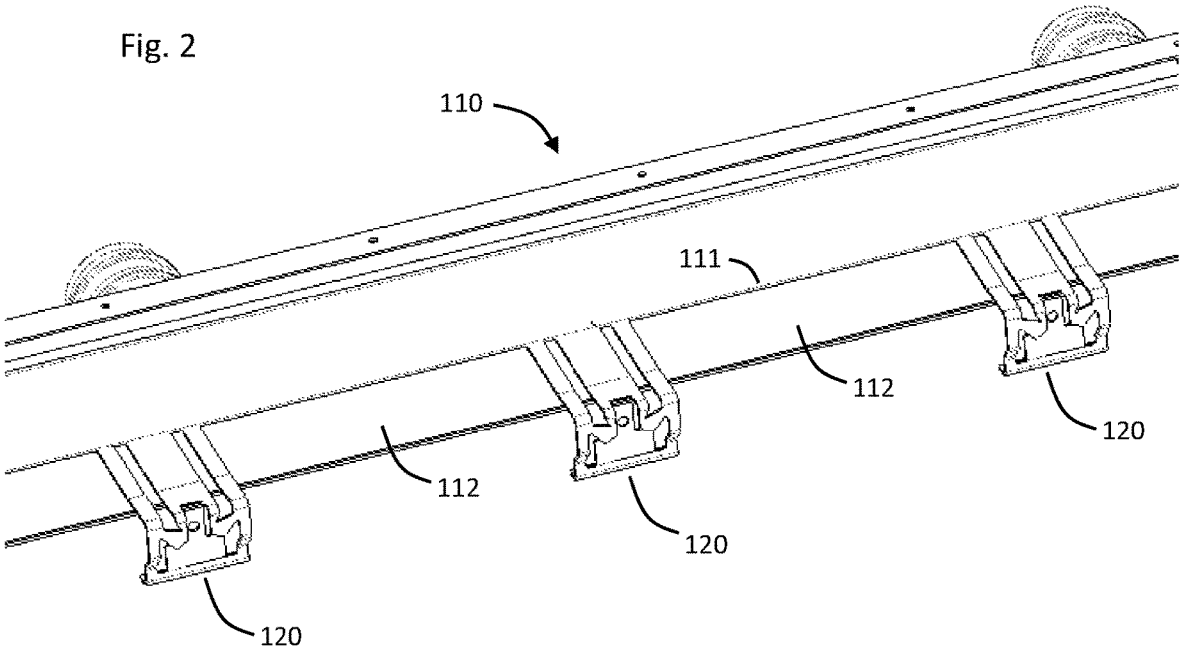
FIG. 2 and FIG. 3 illustrate a housing and liquid guide members which form a part of the apparatus for applying liquid according to an example.
Figure 3:
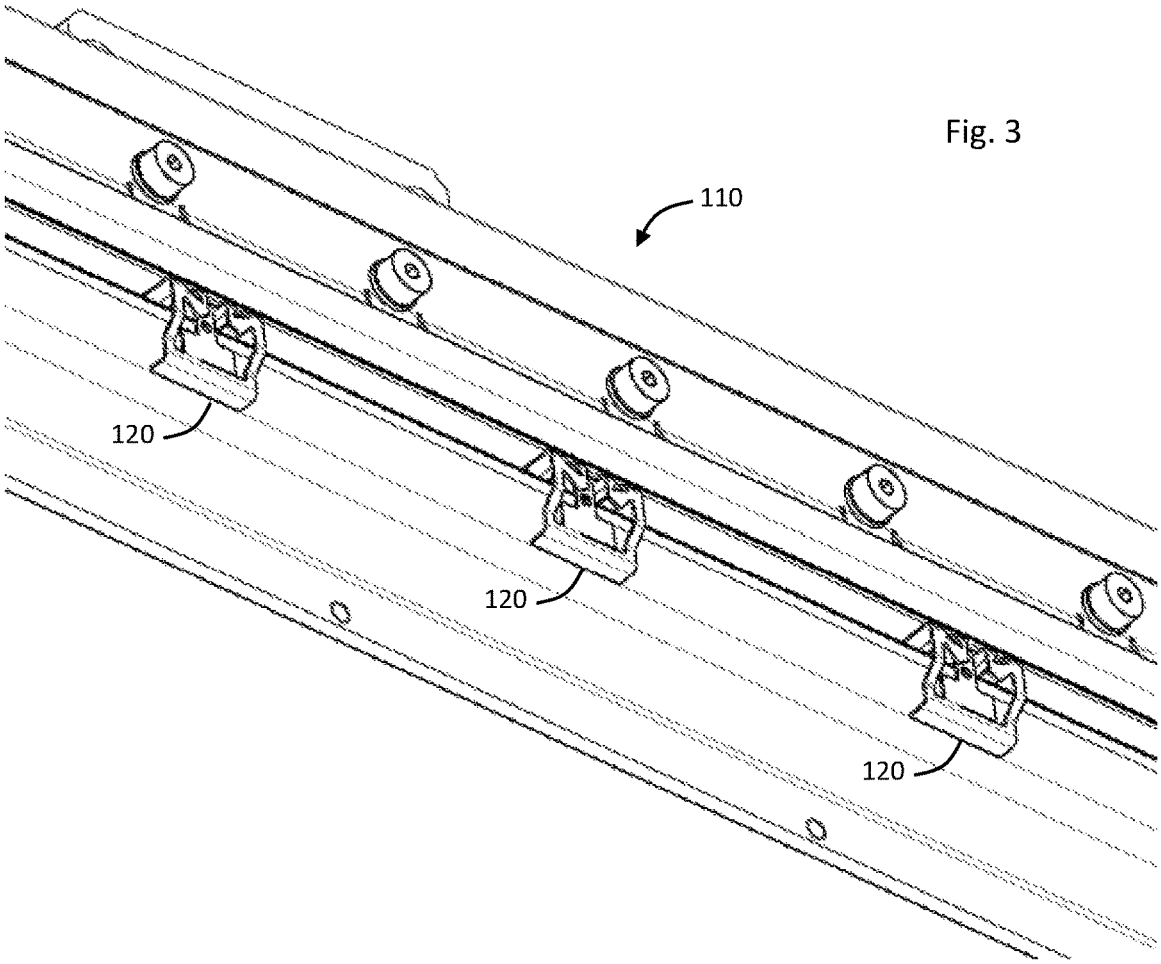

FIGS. 2 and 3 shows the housing 110 and the liquid guide members 120 from different perspectives. In FIG. 2, it can be seen how the liquid guide member 120 fits into an aperture 111 in the housing 110. In use, the housing receives liquid from a pump so that the liquid fills the housing at a predetermined pressure. As the liquid continues to be pumped into the housing 110, the liquid will also flow out of the aperture 111 and across a liquid conduction surface 112 to the anilox roller 150. The anilox roller 150 turns in the direction indicated by the arrow 151, so that the liquid flowing across the liquid conduction surface 112 is spread across the surface of the anilox roller 150.

The aperture 111 shown in FIG. 2 is a slit, in that it is longer on a first axis than it is on a second orthogonal axis, and has a substantially regular width along the length of the longer axis.

Figure 4:
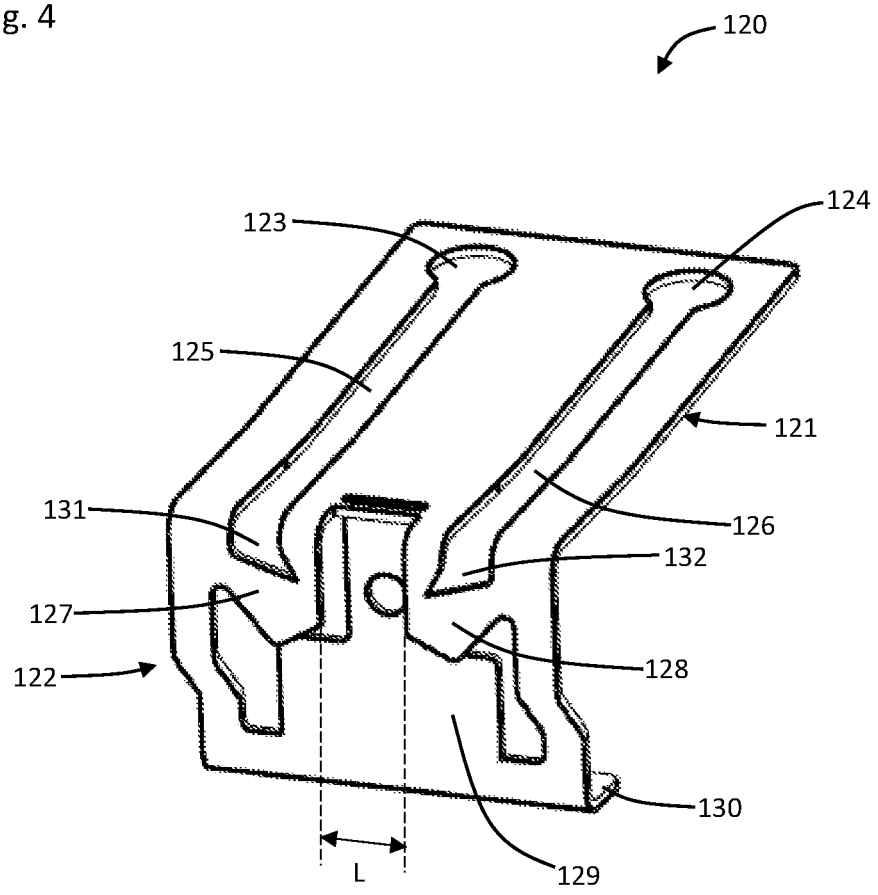
FIG. 4 illustrates the liquid guide member according to an example.

FIG. 4 shows a liquid guide member 120. The guide member 120 comprises an upper plate 121 and a forward plate 122. The upper plate 121 comprises a first inlet 123 and a second inlet 124, the first inlet being connected to a first channel 125 and the second inlet 124 being connected to a second channel 126. The first inlet 123, the second inlet 124, the first channel 125 and the second channel 126 all comprise holes set into the upper plate 121, so that when the guide member 120 is inserted into the aperture 111 of the housing 120, the liquid conduction surface 112 forms a floor of the channels 125, 126.

The upper plate 121 is of a size such that when inserted into the aperture 111 it will obstruct the flow of liquid through the aperture. In particular, the aperture 111 comprises a first side defined by the housing and a second side defined by the housing which is opposite to the first side, and the upper plate 121 extends from the first side to the second side when it is inserted into the aperture 111. As such, the liquid will flow on either side of the liquid guide member 120 but be obstructed in the region of the liquid guide member 120, except where liquid can flow into the inlets 123, 124 and so pass through the aperture 111 and along the channels 125, 126.

As such, liquid in the housing 110 can pass into the first inlet 123, and then into the first channel 125, passing through the aperture 111 and then flowing along the first channel 125 over the liquid conduction surface 112. Similarly, liquid in the housing 110 can pass into the second inlet 124, and then into the second channel 126, passing through the aperture 111 and then flowing along the second channel 126 over the liquid conduction surface 112.

Since the flow of liquid in the vicinity of the liquid guide member 120 is partially obstructed, the total amount of liquid which flows through the aperture 111 in this region is less than the total amount of liquid which flows through the aperture 111 in a similarly sized region which does not contain a liquid guide member 120.

The forward plate 122 of the liquid guide member 120 comprises a first transfer surface 127, a second transfer surface 128 and a support member 129. The support member 129 extends from the upper plate 121 and connects to the parts of the forward plate 122 which provide the first transfer surface 127 and the second transfer surface 128. As such, the support member 129 helps to provide rigidity in the forward plate 122 in use, by resisting deformation of the first transfer surface 127 and the second transfer surface 128. The support member 129 also helps to locate the liquid guide member in the apparatus 100. In particular, the support member 129 comprises a lip 130 which engages with the housing 110 and therefore helps to position the liquid guide member 120 with respect to the housing 110 as shown in FIG. 1 and

FIG. 3.

As the liquid in the first channel 125 arrives at the forward plate 122, it flows onto the first transfer surface 127 and spreads out across the first transfer surface 127. Similarly, as the liquid in the second channel 125 arrives at the forward plate 122, it flows onto the second transfer surface 128 and spreads out across the second transfer surface 128.

The first channel 125 and the second channel 126 are provided with a first wider end section 131 and a second wider end section 132 respectively. The first wider end section 131 and the second wider end section 132 are both wider than the average width of their respective channel 125, 126, when measured in a direction which is orthogonal to the direction of movement of the liquid through the respective channel 125, 126 and orthogonal to the direction of movement of the anilox roller 150. The liquid spreads into the first wider end section 131 and the second wider end section 132 before passing onto the first transfer surface 127 and the second transfer surface 128. This helps to establish an even spread of the liquid across the transfer surfaces 127, 128.

The first transfer surface 127 is wider than the first channel 125, when measured in a direction which is orthogonal to the direction of movement of the liquid through the first channel 125 and to the direction of movement of the anilox roller 150. As such, the liquid will spread out and establish a thinner layer as it flows from the first channel 125 to the first transfer surface 127, such that the rate of flow of liquid across the first transfer surface 127 is less than the rate of flow of liquid across the liquid conduction surface 112.

Similarly, the second transfer surface 128 is wider than the second channel 126, when measured in a direction which is orthogonal to the direction of movement of the liquid through the second channel 126 and to the direction of movement of the anilox roller 150. As such, the liquid will spread out and establish a thinner layer as it flows from the second channel 126 to the second transfer surface 128, such that the rate of flow of liquid across the second transfer surface 128 is less than the rate of flow of liquid across the liquid conduction surface 112.

As can be seen in FIG. 1, the transfer surfaces 127, 128 are proximate to the anilox roller 150. As such, the liquid forms a stable bead between the transfer surfaces 127, 128 and the anilox roller 150, and is transferred from the transfer surfaces 127, 128 to the anilox roller 150.

The first transfer surface 127 and the second transfer surface 128 define a void of width L. The support member 129 is set back from the first transfer surface and the second transfer surface, so that it does not transfer liquid to the anilox roller. Liquid which flows along the channels 125, 126 remains confined to the transfer surfaces 127, 128, and liquid which flows on either side of the liquid guide member 120 is obstructed from reaching the void by the liquid guide member. As such, no liquid reaches the part of the anilox roller which is proximate to the void. The liquid guide member therefore provides a strip on the surface of the anilox roller 150 of width L in which no liquid is applied.

In this way, a coating of liquid is applied across a surface such as the surface of the Anilox roller 150, except in a lane which corresponds to the void defined by the liquid guide member or members 120. The lane may then be used for purposes which would be prevented by the presence of the liquid.

The liquid can be transferred from the anilox roller to a further surface, the further surface being coated in the liquid except in strips whose width and location is defined by the size and location of the liquid guide members 120. In a particular example an adhesive may be applied in these strips, for example to attach a laminate covering to the further surface.

If there is an excess of liquid reaching the forward plate 122, the excess will tend to flow down the side of the forward plate 122 which is opposite to the anilox roller, and as such it will not reach the anilox roller.

The first doctor blade 140 is located adjacent to the housing 110 and the first guide member 120 as shown in FIG. 1, so that the first doctor blade 140 passes over the surface of the anilox roller 150 after the liquid is applied. The first doctor blade 140 scrapes away any excess liquid on the surface of the anilox roller 150.

The second doctor blade 141 is also located adjacent to the housing 110 and the liquid guide member 120, but it is arranged so that the second doctor blade passes over the surface of the anilox roller 150 before the liquid is applied.

As such, the first doctor blade 140, the second doctor blade 141, the housing 110 and the anilox roller 150 define an enclosed space in which the liquid is contained, except where the liquid is moved out of the enclosed space on the anilox roller.

The second doctor blade 141 helps to restrain any flow of liquid which might otherwise pass over the exposed surface of the upper plate 121 of the liquid guide member, and so helps to prevent the transfer surfaces 127, 128 receiving too much liquid. As such, the second doctor blade 141 helps to maintain a stable bead between the transfer surfaces 127, 128 and the anilox roller 150, and therefore helps to prevent liquid flowing into the void defined by the transfer surfaces 127, 128.

The liquid guide member 120 can be inserted at any position in the aperture 111, in order to provide a strip on the surface of the anilox roller 150 in which no liquid is applied at any desired position along the longitudinal axis of the anilox roller 150. As can be seen in FIG. 2, a plurality of liquid guide members can be inserted into the aperture 111 in order to provide a plurality of strips on the surface of the anilox roller 150 in which no liquid is applied. Although three liquid guide members are shown, it is possible to use one, two, four or any other number of liquid guide members 120 in order to provide the desired number of strips.

In an alternative example of a liquid guide member, the inlets and/or channels of the liquid guide member may be provided as grooves in an upper plate, so that floors of the inlets and the channels are provided by the material of the liquid guide member.

Figure 5:
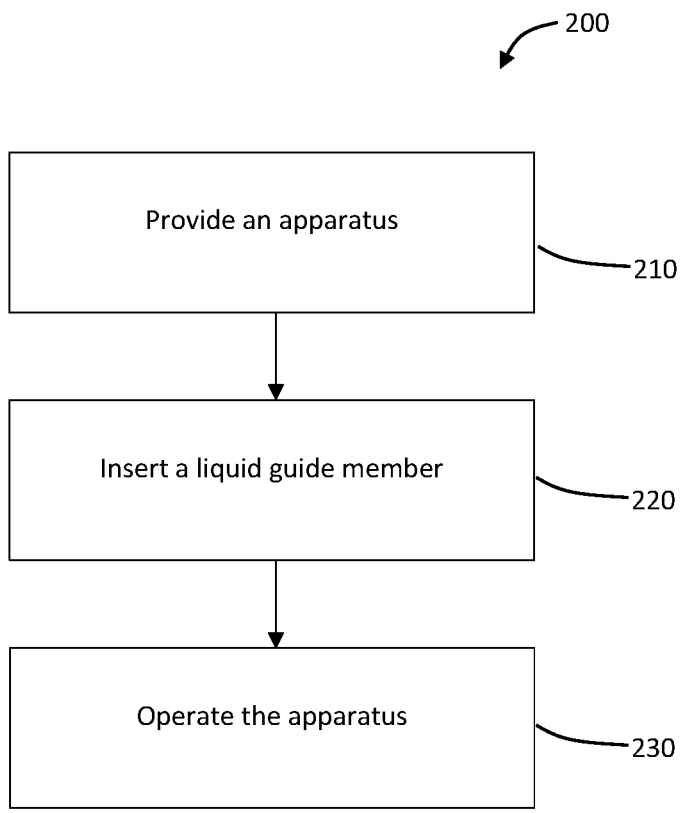
FIG. 5 is a flow chart of a method according to an example.

FIG. 5 shows a method for applying liquid to a printing surface 200. The method comprises providing an apparatus in section 210. The apparatus comprises a housing arranged to receive the liquid, and the housing comprises an aperture. The aperture comprises at least a first side defined by the housing and a second side defined by the housing which is opposite to the first side, such that the liquid can flow out of the housing by passing through the aperture between the first side and the second side.

The method 200 further comprises inserting a liquid guide member into the aperture in section 220. The liquid guide member is inserted into the aperture so that it extends from the first side to the second side. The liquid guide member comprises a first transfer surface, a second transfer surface which is separated from the first transfer surface by a gap, a first channel which extends from a first inlet adjacent to the aperture to the first transfer surface, and a second channel which extends from a second inlet adjacent to the aperture to the second transfer surface.

The method 200 further comprises operating the apparatus in section 230. When the apparatus is operated, liquid will flow along the first channel from the aperture to the first transfer surface and then transfer from the first transfer surface onto the printing surface, and the liquid will flow along the second channel from the aperture to the second transfer surface and then transfer from the second transfer surface onto the printing surface as the printing surface moves relative to the apparatus.

The liquid may be one which is intended as a preparatory coat for a surface to which other substances, such as inks, may be subsequently applied. The liquid may be a primer.

Throughout the description and claims of this specification, the words "comprise" and "contain" and variations of them mean "including but not limited to", and they are not intended to (and do not) exclude other components, integers or operations. Throughout the description and claims of this specification, the singular encompasses the plural unless the context demands otherwise. In particular, where the indefinite article is used, the specification is to be understood as contemplating plurality as well as singularity, unless the context demands otherwise.

Features, integers or characteristics described in conjunction with a particular aspect or example are to be understood to be applicable to any other aspect or example described herein unless incompatible therewith. All of the features disclosed in this specification (including any accompanying claims, abstract and drawings), and/or all of the elements of any method or process so disclosed, may be combined in any combination, except combinations where at least some of such features and/or operations are mutually exclusive. Implementations are not restricted to the details of any foregoing examples.

The invention claimed is:

1. An apparatus for applying a liquid to a printing surface, the apparatus comprising:

a housing arranged to receive the liquid, the housing comprising an aperture and the aperture comprising at least a first side defined by the housing and a second side defined by the housing which is opposite to the first side, such that the liquid can flow out of the housing by passing through the aperture between the first side and the second side; and a liquid guide member which is inserted into the aperture so that the liquid guide member extends from the first side to the second side, wherein the liquid guide member comprises:

a first transfer surface;

a second transfer surface which is separated from the first transfer surface by a gap;

a first channel which extends from a first inlet adjacent to the aperture to the first transfer surface; and a second channel which extends from a second inlet adjacent to the aperture to the second transfer surface, the liquid guide member being arranged such that in use the liquid will flow along the first channel from the aperture to the first transfer surface and then transfer from the first transfer surface onto the printing surface, and the liquid will flow along the second channel from the aperture to the second transfer surface and then transfer from the second transfer surface onto the printing surface as the printing surface moves relative to the apparatus.

2. An apparatus according to claim 1, wherein the first inlet has a first width at its widest point and the first transfer surface has a second width at its widest point, the widths of the first inlet and the first transfer surface being measured in a direction which is orthogonal to the direction of movement of the liquid through the first channel and to the direction of movement of the printing surface relative to the apparatus, and wherein the second width is greater than the first width.

3. An apparatus according to claim 1, wherein the second inlet has a third width at its widest point and the second transfer surface has a fourth width at its widest point, the widths of the second inlet and the second transfer surface being measured in a direction which is orthogonal to the direction of movement of the liquid through the second channel and to the direction of movement of the printing surface relative to the apparatus, and wherein the fourth width is greater than the third width.

4. An apparatus according to claim 1, wherein the first channel is wider at the end adjacent to the first transfer surface than it is at the end adjacent to the first inlet, the width of the first channel being measured in a direction which is parallel to the direction of movement of the liquid through the first channel and to the direction of movement of the printing surface relative to the apparatus.

5. An apparatus according to claim 1, wherein the second channel is wider at the end adjacent to the second transfer surface than it is at the end adjacent to the second inlet, the width of the second channel being measured in a direction which is parallel to the direction of movement of the liquid through the second channel and to the direction of movement of the printing surface relative to the apparatus.

6. An apparatus according to claim 1, wherein the liquid is transferred from the printing surface to a further surface.

7. An apparatus according to claim 6, wherein the printing surface is the surface of an anilox roller.

8. An apparatus according to claim 1, wherein the apparatus comprises a first doctor blade, the first doctor blade being arranged adjacent to the aperture and the liquid guide member so that it contacts the printing surface, the first doctor blade being arranged to pass over the printing surface after the liquid has been applied.

9. An apparatus according to claim 1, wherein the apparatus comprises a second doctor blade, the second doctor blade being arranged adjacent to the aperture and the liquid guide member so that it contacts the printing surface, the second doctor blade being arranged to pass over the printing surface before the liquid has been applied.

10. An apparatus according to claim 1, the apparatus further comprising a pump which is arranged to maintain a target pressure of liquid in the housing.

11. An apparatus according to claim 1, wherein the liquid comprises a primer.

12. A liquid guide member for use with a an apparatus for applying a liquid to a printing surface, wherein the apparatus comprises a housing arranged to receive the liquid, the housing comprising an aperture and the aperture comprising at least a first side defined by the housing and a second side defined by the housing which is opposite to the first side, such that the liquid can flow out of the housing by passing through the aperture between the first side and the second side, the liquid guide member being suitable for insertion into the aperture so that the liquid guide member extends from the first side to the second side, and comprising:

a first transfer surface;

a second transfer surface which is separated from the first transfer surface by a gap;

a first channel which extends from a first inlet adjacent to the aperture to the first transfer surface; and a second channel which extends from a second inlet adjacent to the aperture to the second transfer surface, the liquid guide member being arranged such that in use the liquid will flow along the first channel from the aperture to the first transfer surface and then transfer from the first transfer surface onto the printing surface, and the liquid will flow along the second channel from the aperture to the second transfer surface and then transfer from the second transfer surface onto the printing surface as the printing surface moves relative to the apparatus.

13. A method of applying liquid to a printing surface, the method comprising:

providing an apparatus which comprises a housing arranged to receive the liquid, the housing comprising an aperture and the aperture comprising at least a first side defined by the housing and a second side defined by the housing which is opposite to the first side, such that the liquid can flow out of the housing by passing through the aperture between the first side and the second side;

inserting a liquid guide member into the aperture so that the liquid guide member extends from the first side to the second side, the liquid guide member comprising:

a first transfer surface;

a second transfer surface which is separated from the first transfer surface by a gap;

a first channel which extends from a first inlet adjacent to the aperture to the first transfer surface; and a second channel which extends from a second inlet adjacent to the aperture to the second transfer surface, the liquid guide member being arranged such that in use the liquid will flow along the first channel from the aperture to the first transfer surface and then transfer from the first transfer surface onto the printing surface, and the liquid will flow along the second channel from the aperture to the second transfer surface and then transfer from the second transfer surface onto the printing surface as the printing surface moves relative to the apparatus.

* * * * *